US010627762B2

(12) United States Patent
Kawanago et al.

(10) Patent No.: US 10,627,762 B2
(45) Date of Patent: Apr. 21, 2020

(54) IMAGE FORMING APPARATUS AND COMPUTER READABLE STORAGE MEDIUM STORING PROGRAM

(71) Applicant: KONICA MINOLTA, INC., Chiyoda-ku, Tokyo (JP)

(72) Inventors: Takashi Kawanago, Fuchu (JP); Satoshi Nishida, Saitama (JP); Takeshi Maeyama, Hachioji (JP); Toshiki Hayami, Hachioji (JP); Tomo Kitada, Yokohama (JP); Daisuke Murakami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/191,895

(22) Filed: Nov. 15, 2018

(65) Prior Publication Data

US 2019/0146396 A1 May 16, 2019

(30) Foreign Application Priority Data

Nov. 16, 2017 (JP) ..... 2017-220579

(51) Int. Cl.
*G03G 15/00* (2006.01)

(52) U.S. Cl.
CPC ..... *G03G 15/5062* (2013.01); *G03G 15/5029* (2013.01)

(58) Field of Classification Search
CPC ..... G03G 15/5062; G03G 15/5029
See application file for complete search history.

(56) References Cited

U.S. PATENT DOCUMENTS

| | | | | |
|---|---|---|---|---|
| 10,274,883 | B1 * | 4/2019 | Kuo | G03G 15/5062 |
| 2007/0237533 | A1 * | 10/2007 | Hanashi | G03G 15/161 399/49 |
| 2010/0008684 | A1 * | 1/2010 | Matsumoto | G03G 15/0822 399/45 |
| 2010/0111547 | A1 * | 5/2010 | Kawamoto | G03G 15/5062 399/30 |
| 2015/0261163 | A1 * | 9/2015 | Ishii | G03G 15/5025 250/559.16 |
| 2018/0220038 | A1 * | 8/2018 | Sakata | G03G 15/5062 |

FOREIGN PATENT DOCUMENTS

JP 2011257727 A 12/2011

OTHER PUBLICATIONS

Kondo et al.; Dec. 22, 2011; JP 2011-257727; Ricoh Co. LTD; Cited portions of English Translation.*

* cited by examiner

*Primary Examiner* — Neil R McLean
(74) *Attorney, Agent, or Firm* — Holtz, Holtz & Volek PC

(57) ABSTRACT

An image forming apparatus which forms a toner image on an image carrier based on image formation data, and transfers the toner image onto a sheet having an unevenness on a surface and forms an image, the image forming apparatus including a hardware processor which detects a parameter value regarding a charging amount of a toner that forms the toner image, sets a size of a dot of the toner image according to the detected parameter value, and generates the image formation data of the dot of the set size.

7 Claims, 8 Drawing Sheets

IMAGE FORMING APPARATUS AND COMPUTER READABLE STORAGE MEDIUM STORING PROGRAM

BACKGROUND

1. Technological Field

The present invention relates to an image forming apparatus and a computer readable storage medium storing a program.

2. Description of the Related Art

In an electrophotographic image forming apparatus, an image is fixed on a sheet by heating/pressurizing the sheet after toner images formed on the image carrier are transferred onto the sheet.

It is known that, when such an image forming apparatus uses a sheet processed to have an unevenness (such as embossed paper) as the image formation target, the toners cannot reach the concaves of the sheet easily at the time of transferring due to the long distance from the toners on the image carrier, and thus the transferability is bad.

Thus, in order to improve the transferability to the concaves of the sheet, there is suggested a technique of generating pixel data able to form a gradation pattern having a same or a nearly same average density as that of the gradation pattern which is used for a sheet having a flat surface, according to the density of the document image and the unevenness state of the sheet surface (for example, JP 2011-257727 A).

However, the technique described in the above JP 2011-257727 A does not consider the state of the toner itself as a factor that contributes to the transferability of toners to the concaves of the sheet.

Thus, it has been difficult to maintain a good transferability onto the concaves of the sheet in a case where the toner state such as a toner charging amount changes according to the use environment and use history.

SUMMARY

The present invention has been made in consideration of the above problems, and an object of the present invention is to achieve a constant good transferability with respect to the sheet having the unevenness on the surface.

To achieve at least one of the abovementioned objects, according to an aspect of the present invention, an image forming apparatus reflecting one aspect of the present invention forms a toner image on an image carrier based on image formation data, and transfers the toner image onto a sheet having an unevenness on a surface and forms an image, the image forming apparatus including a hardware processor which detects a parameter value regarding a charging amount of a toner that forms the toner image, sets a size of a dot of the toner image according to the detected parameter value, and generates the image formation data of the dot of the set size.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF THE EMBODIMENTS

Hereinafter, one or more embodiments of the present invention will be described in detail with reference to the drawings. However, the scope of the invention is not limited to the disclosed embodiments or illustrated examples.

[Configuration of Image Forming Apparatus]

First, the configuration of the image forming apparatus in the embodiment will be described.

Figure 1:
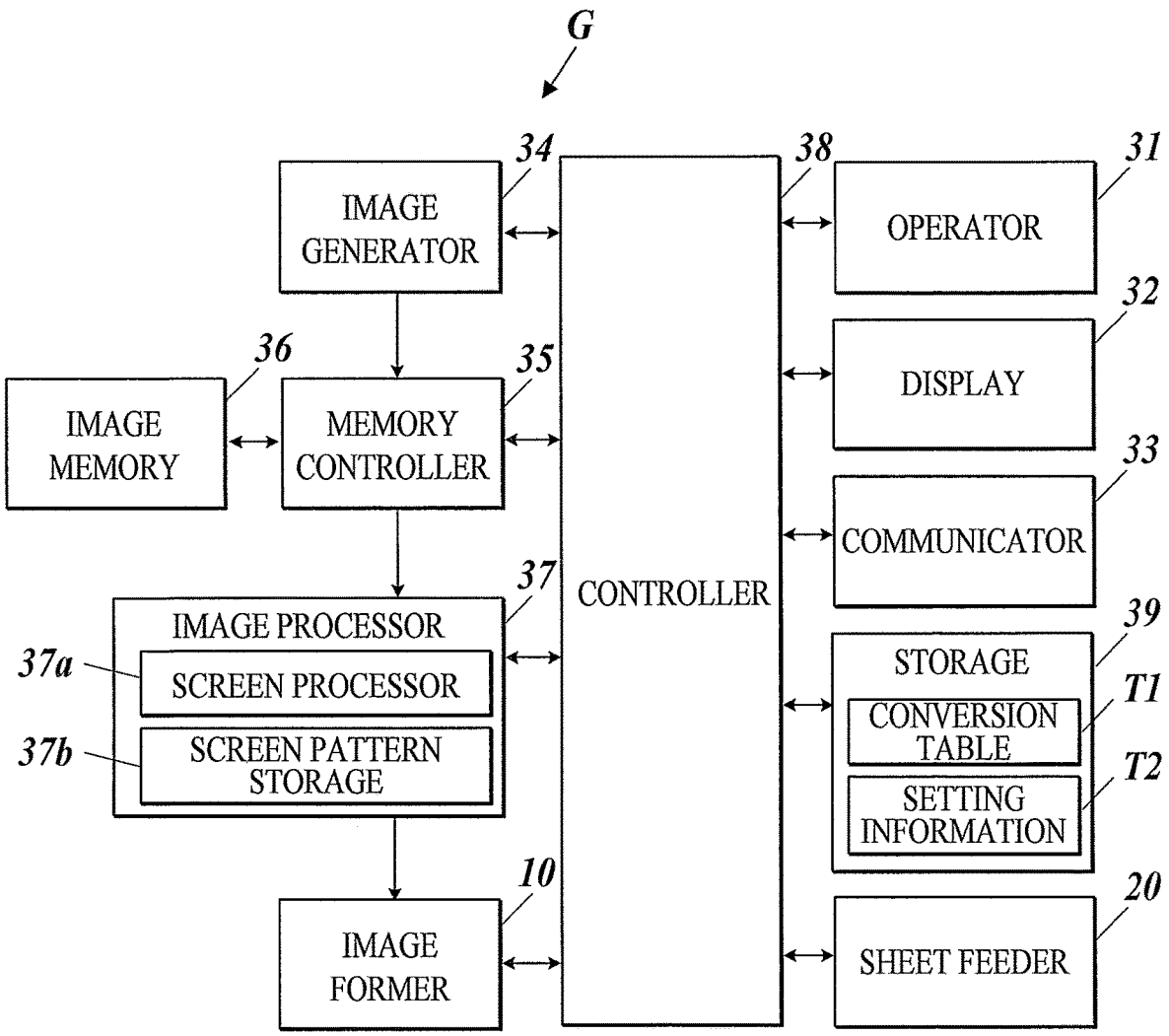
FIG. 1 is a block diagram showing a functional configuration of an image forming apparatus.

FIG. 1 is a block diagram showing the functional configuration of an image forming apparatus G in the embodiment.

As shown in FIG. 1, the image forming apparatus G includes, for example, an image former 10, a sheet feeder 20, an operator 31, a display 32, a communicator 33, an image generator 34, a memory controller 35, an image memory 36, an image processor 37, a controller 38 and a storage 39.

Figure 2:
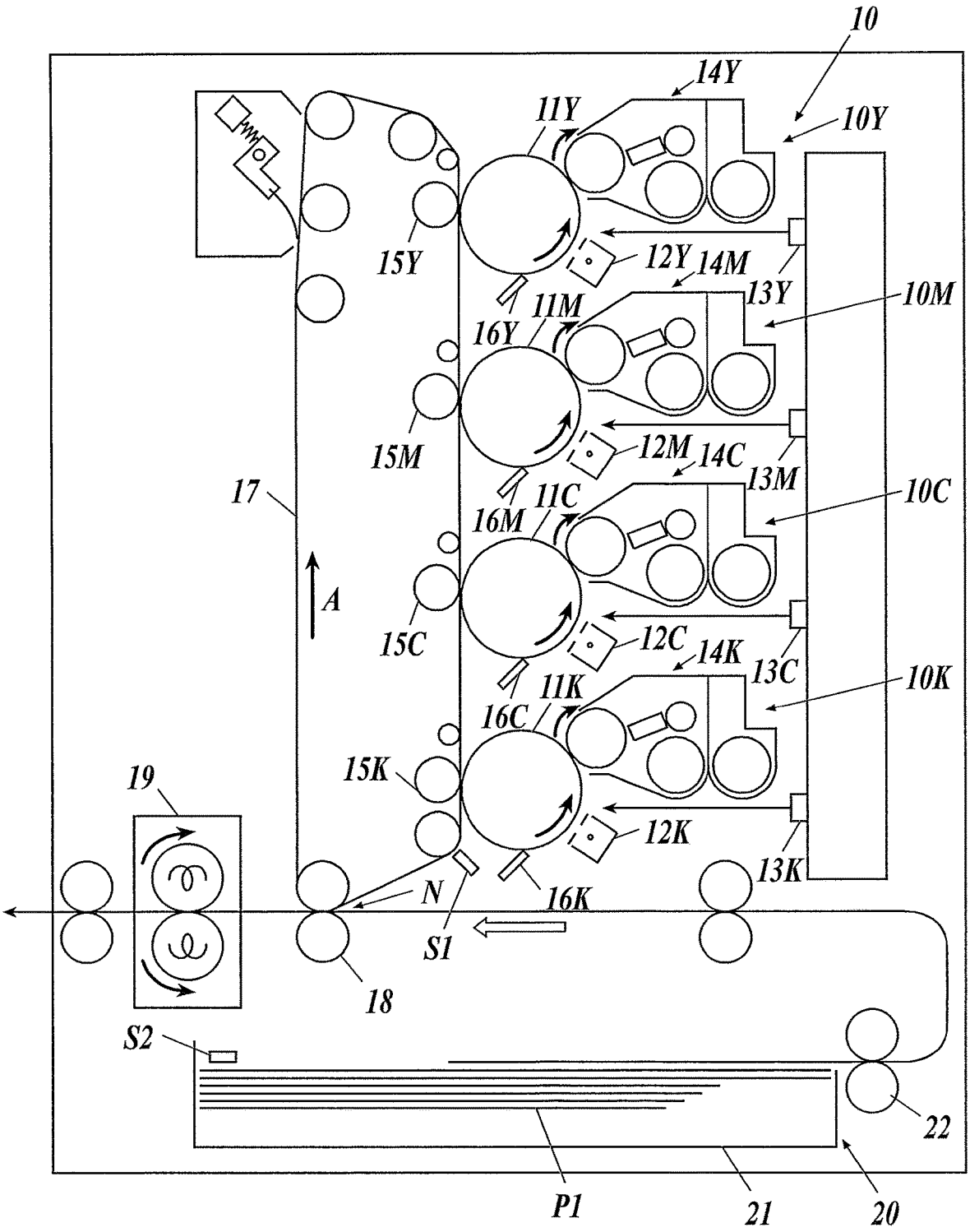
FIG. 2 is a schematic configuration view of an image former.

FIG. 2 is a schematic configuration view of the image former 10.

As shown in FIG. 2, the image former 10 includes four writing units 10Y, 10M, 10C and 10K corresponding to respective colors of Y (yellow), M (magenta), C (cyan) and K (black), an intermediate transfer belt (image carrier) 17, a secondary transfer roller 18, a fixer 19 and a density sensor S1.

Figure 3:
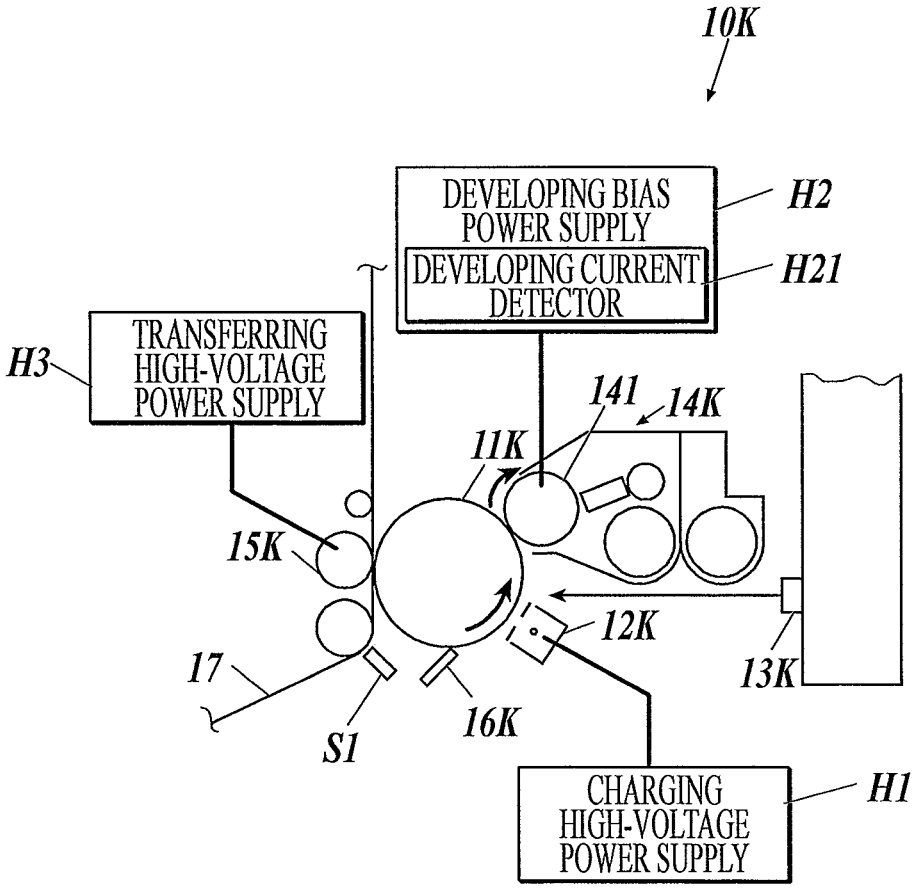
FIG. 3 is a view showing peripheral sections in a writing unit of the image former.

FIG. 3 is a view showing the peripheral sections in the writing unit 10K of the image former 10.

Since each of the writing units 10Y, 10M, 10C and 10K has a same configuration, the writing unit 10K will be hereinafter explained as a representative, and the explanation of the writing units 10Y, 10M and 10C is omitted.

As shown in FIG. 3, the writing unit 10K includes a photosensitive drum (image carrier) 11K, a charger 12K, an exposure section 13K, a developer 14K, a primary transfer roller 15K and a cleaner 16K.

The charger 12K receives a predetermined voltage by a charging high-voltage power supply H1 and uniformly charges the photosensitive drum 11K.

The exposure section 13K is configured by including a laser source, a polygon mirror, a lens and the like, and forms an electrostatic latent image by scanning and exposure with laser beams on the surface of the photosensitive drum 11K on the basis of image data of each color (here, K).

The developer 14K performs developing by attaching toners of each color (here, K) to the electrostatic latent image on the photosensitive drum 11K.

The toners used in the developer 14K include toner particles and carriers for charging the toner particles. As the toner particles, there can be used various known toner particles. There can be used such toner particles that coloring agent and, if necessary, charge control agent, release agent or the like are contained in binder resin, and external additive agent for adjusting charging property, flow property and the like of the toner particles is processed. As the external additive agent, there can be used metal oxide of fine particles such as silica and titania, for example. As the carriers, various known carriers can be used. Binder-type carriers, coat-type carriers and such like can be used.

The developer 14K includes a developing roller 141 formed by including a rotatable developing sleeve and a magnet roller which generates a fixed magnetic field. There is applied, to the developing sleeve, a voltage obtained by superposing a direct current voltage on the alternating current voltage from the developing bias power supply H2.

The developing current flowing between the developing roller 141 and the photosensitive drum 11K at the time of developing is measured by the developing current detector H21. The developing current is generated when the toners move from the surface of the developing roller 141 to the photosensitive drum 11K during the developing. Since the developing current is proportional to the total amount of electric charges per unit time of the moved toners, it is possible to measure the total amount of electric charges of the developed toners by measuring the developing current.

The primary transfer roller 15K forces the intermediate transfer belt 17 toward the photosensitive drum 11K from the back surface (surface opposite to the surface on which the toner image is formed). A predetermined fixed voltage or a fixed current is applied to the primary transfer roller 15K by the transferring high-voltage power supply H3. The toner image formed on the photosensitive drum 11K is transferred onto the intermediate transfer belt 17 by the electrostatic action of the primary transfer roller 15K to which the fixed voltage or the fixed current is applied (primary transferring).

The cleaner 16K removes the toners remaining on the peripheral surface of the photosensitive drum 11K after the transferring.

As described above, on the intermediate transfer belt 17, toner images of respective colors are formed so as to be superposed on each other by the writing units 10Y, 10M, 10C and 10K, and color toner images are formed.

The intermediate transfer belt 17 is an endless belt, tensioned by a plurality of rollers (drive roller, tension roller and driven roller), and rotated in the direction shown by the arrow A in FIG. 2.

As the intermediate transfer belt 17, for example, there can be used an elastic belt having an elastic layer formed of rubber such as acrylonitrile butadiene copolymerized rubber (NBR) and chloroprene rubber (CR), on the base material layer formed of resin such as polyimide (PI) and Polyphenylenesulfide (PPS).

It is sufficient that the intermediate transfer belt 17 has a desired transferability, and the material and thickness are not limited to the above.

Returning to FIG. 2, the secondary transfer roller 18 transfers the color toner images formed on the intermediate transfer belt 17 together onto one surface of the sheet supplied from the sheet feeder 20 (secondary transferring).

The fixer 19 fixes the toners, which was transferred onto the sheet, on the sheet by heating and pressurizing.

The density sensor S1 is a reflection type photo sensor, for example.

The density sensor S1 is located at a position downstream of the photosensitive drum 11K which is on the most downstream side, and upstream of the nip position of the secondary transfer roller 18, in the rotation direction of the intermediate transfer belt 17.

The density sensor S1, for example, measures the optical reflection density of a patch image when the patch image of toners for each color of Y, M, C and K is formed on the intermediate transfer belt 17.

The sheet feeder 20 is provided in the lower section of the image forming apparatus G and includes a sheet feeding cassette 21 which can be attached and detached. The sheets contained in the sheet feeding cassette 21 are sent to the conveyance path by the sheet feeding roller 22 one by one from the upmost sheet.

In the embodiment, image formation can be performed on, as a sheet, not only plain paper having a flat surface, but also paper having the unevenness (hereinafter, referred to as "embossed paper P1") on the surface.

The sheet feeding cassette 21 has a detection sensor S2 which detects the sheet surface shape (such as unevenness) and the depth of the unevenness if there is any unevenness, and thus can detect that embossed paper P1 is contained in the sheet feeding cassette 21.

Returning to FIG. 1, the operator 31 includes operation keys, a touch panel integrally formed with a display 32 and the like, and outputs the operation signals corresponding to these operations to the controller 38.

The user can perform an input operation such as job setting and changing a processing content, with the operator 31.

The user can perform a selection operation to select the type of sheet on which an image is to be formed in the job, for example, with the operator 31. Specifically, the storage 39 stores a list of sheet types registered in advance. It is possible to select one of the sheet types by causing the display 32 to display the list.

The display 32 includes an LCD (Liquid Crystal Display), for example, and displays various screens in accordance with the instruction by the controller 38.

The communicator 33 communicates with a computer on network, for example, a user terminal, a server and another image forming apparatus, in accordance with the instruction by the controller 38. The communicator 33 receives data described in PDL (Page Description Language) from the user terminal, for example.

The image generator 34 performs rasterizing processing to the data described in PDL which was received by the communicator 33, and generates bitmap image data having a tone value for each pixel, for each color of Y, M, C and K. The tone value is a signal value representing the gradation level of the image within the range of 0 to 100%.

The image generator 34 includes a scanner, and can generate image data of each color of R (red), G (green) and B (blue) by reading the document, which was set by the user, with the scanner. The image generator 34 performs color conversion processing of image data of each color of R, G and B and generates image data of each color of C, M, Y and K.

The memory controller 35 writes the image data generated by the image generator 34 into the image memory 36, and stores the image data. The memory controller 35 reads out the image data from the image memory 36 and outputs it to the image processor 37.

As the image memory 36, a DRAM (Dynamic RAM) can be used, for example.

The image processor 37 performs various types of image processing necessary for image formation to image data of C, M, Y and K read out from the image memory 36, and generates image data for image formation. The generated image data is output to the image former 10 as image formation data.

Specifically, the image processor 37 has a screen processor 37*a* and a screen pattern storage (first storage) 37*b*, and executes screen processing of converting the pixel value of the image. In FIG. 1, there is shown component parts of the image processor 37 which mainly function at the time of screen processing.

The screen processor 37*a* performs screen processing to image data with a screen pattern SP selected from among a plurality of screen patterns SP stored in the screen pattern storage 37*b* under control by the controller 38.

The screen pattern storage 37*b* stores a plurality of screen patterns SP which are different from each other.

The screen pattern SP is a matrix having a predetermined number of image spots, and the plurality of screen patterns SP have dots having sizes different from each other.

Figure 4A:
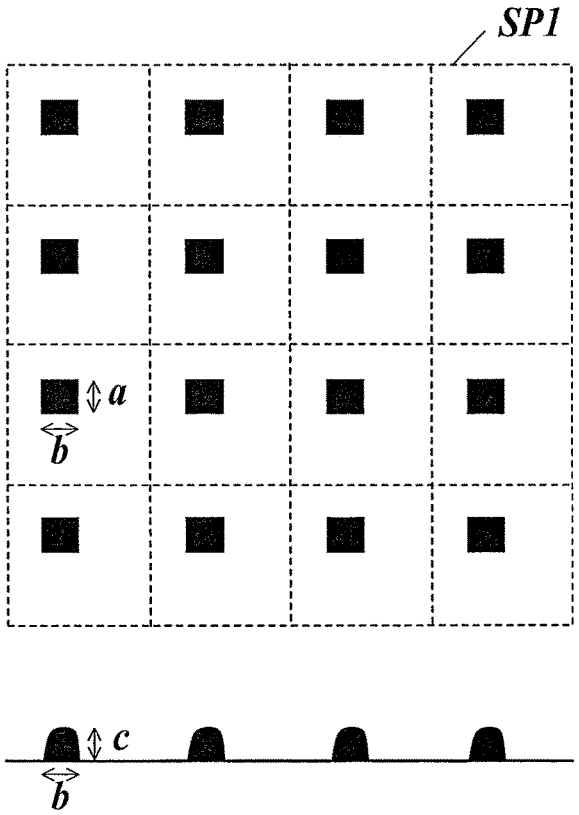
FIG. 4A is a view showing an example of a screen pattern.
Figure 4B:
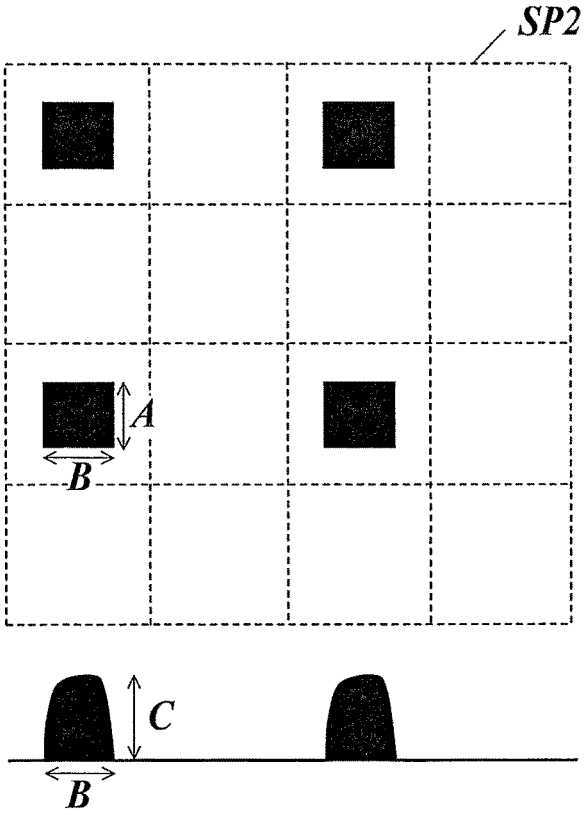
FIG. 4B is a view showing an example of a screen pattern.

FIGS. 4A and 4B are views showing examples of screen patterns SP stored in the screen pattern storage 37*b*.

FIG. 4A shows a standard screen pattern SP1 which is set to be used when normal image formation is performed. FIG. 4B shows a screen pattern SP2 having dots which are the smallest next to the screen pattern SP1.

In each of the examples, the screen pattern SP is formed of 4×4 squares (16 image spots).

Here, the dots in the screen pattern SP are the smallest dots of the toner image to be created. That is, the size of the smallest dots of the toner image to be created is changed according to the screen pattern SP which is used.

All of the screen patterns SP have same toner amounts inside the screen patterns SP. That is, when the toner amounts corresponding to all the dots inside the screen pattern SP are added up, the value is same for each of the screen patterns SP.

Thus, for example, when the screen pattern SP1 having small dots is compared with the screen pattern SP2 having large dots, in the screen pattern SP2, the distance between dots is broader than that of the screen pattern SP1, and the vertical and horizontal sizes and height (A, B and C) of each dot are larger than the vertical and horizontal sizes and height (a, b and c) of each dot in the screen pattern SP1.

The controller 38 includes a CPU (Central Processing Unit), a RAM (Random Access Memory) and the like. The controller 38 controls each component of the image forming apparatus G by reading and executing the program stored in the storage 39.

For example, the controller 38 causes the image generator 34 to generate image data of bitmap format, and causes the image processor 37 to perform image processing to the image data. The controller 38 causes the image former 10 to form an image on the sheet on the basis of the image data which was subjected to the image processing.

The storage 39 stores programs, files and the like which are readable by the controller 38.

As the storage 39, a storage medium such as a hard disk and a ROM (Read Only Memory) can be used.

For example, the storage 39 stores a conversion table T1 which is used when after-mentioned toner charging amount detection processing is executed. The conversion table T1 is a table in which the correspondence relationship between the optical reflection density and the toner attachment amount is described in advance, and the optical reflection density value measured by the density sensor S1 can be converted to the toner attachment amount by referring to the table.

The storage 39 stores setting information T2 which is used when after-mentioned screen pattern setting processing is executed.

Figure 5:
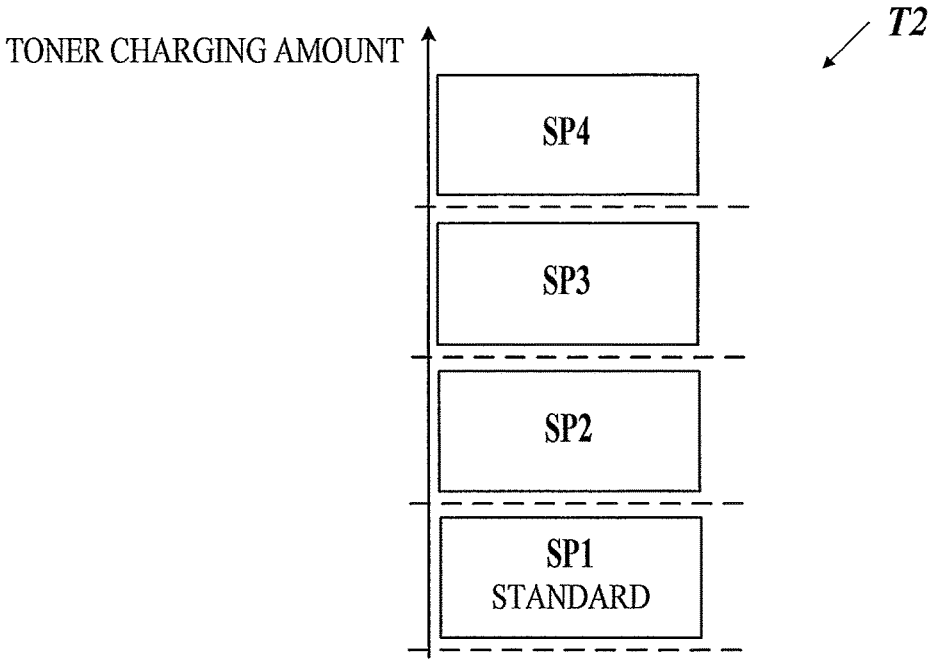
FIG. 5 is a view showing an example of setting information.

FIG. 5 is a view showing an example of the setting information T2.

As shown in FIG. 5, the setting information T2 is information in which the correspondence relationship between the toner charging amount and the screen pattern SP is described in advance. In the setting information T2, the screen pattern SP is associated with the toner charging amount so that the size of dots gradually increases as the value of the toner charging amount (absolute value) increases.

In the screen pattern setting processing, it is possible to select a screen pattern SP corresponding to the toner charging amount detected in the toner charging amount detection processing by referring to the setting information T2.

[Operation of Image Forming Apparatus]

Next, the operation of the image forming apparatus G in the embodiment will be described.

In the image forming apparatus G in the embodiment, the image forming processing to the embossed paper P1 is executed, and at this time, the good transferability is maintained by controlling the size of the dots of toner image to be formed on the basis of the charging amount of the toners (toners contained in the developer 14Y or the like) used in image formation.

Figure 6:
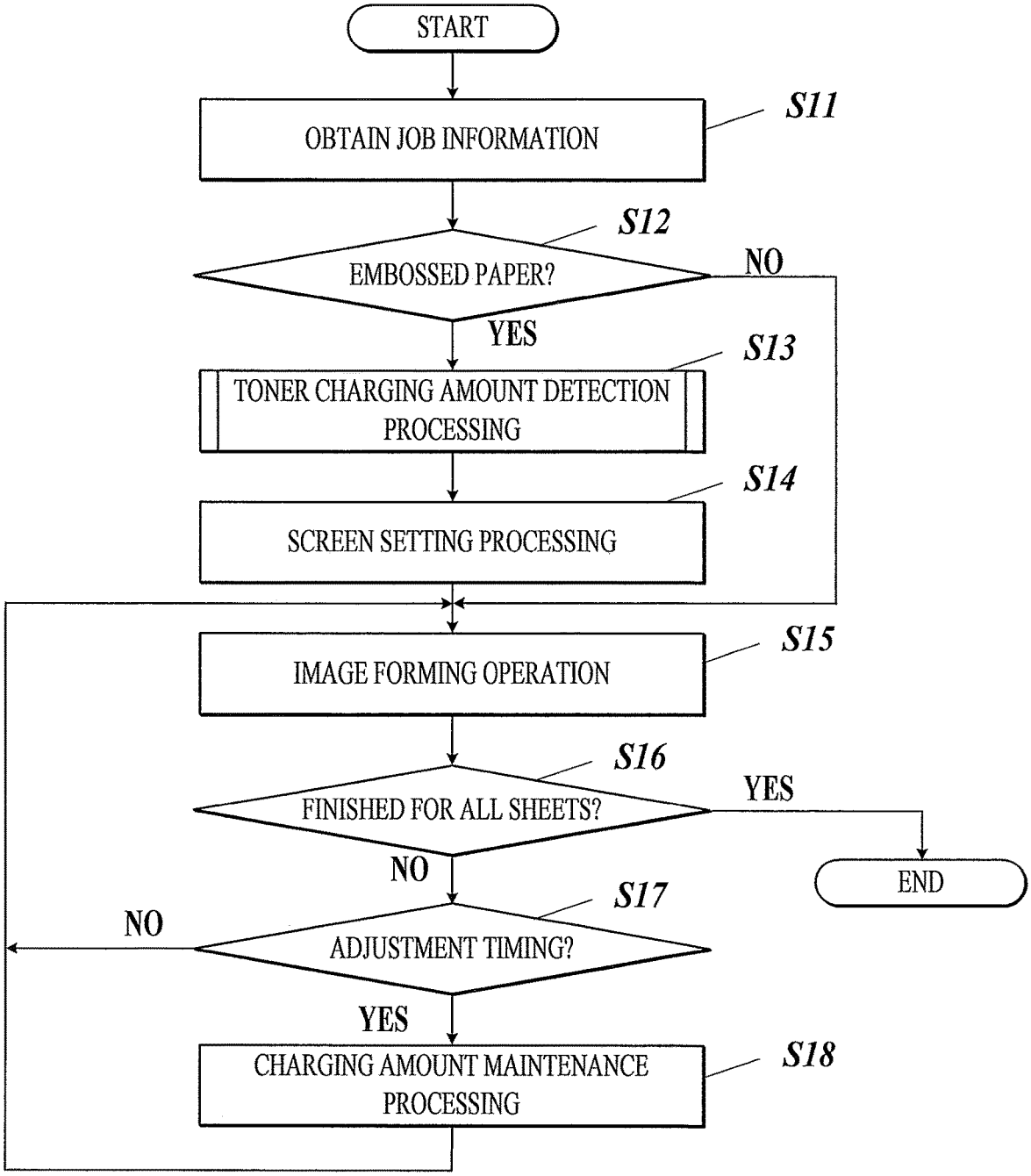
FIG. 6 is a flowchart showing an operation of the image forming apparatus.

FIG. 6 is a flowchart showing image forming processing performed to the embossed paper P1 by the image forming apparatus G.

The image forming processing is executed in cooperation between the controller 38 and the program stored in the storage 39 in accordance with the execution instruction of job from a user.

First, when the execution instruction of job is received, the controller 38 obtains the job information regarding the job (step S11).

The job information includes sheet number information or the like indicating the number of sheets to form an image in the job.

Next, the controller 38 determines whether the sheet to perform image formation is embossed paper P1 (step s12).

Specifically, the controller 38 determines that the sheet to form an image is embossed paper P1 by the instruction signal corresponding to selection operation to the operator 31 in a case where the user performs, via the operator 31, the selection operation of the embossed paper P1 as the type of sheet to perform image formation in the job prior to the execution instruction of job.

If the sheet is not the embossed paper P1 (step S12: NO), the controller 38 proceeds to after-mentioned step S15.

On the other hand, if the sheet is the embossed paper P1 (step S12: YES), the controller 38 executes toner charging amount detection processing of detecting the charging amount of each toner of Y, M, C and K (step S13).

Here, with reference to FIGS. 7 and 8, the toner charging amount detection processing to the toners of Y, M and C will be described. Since the toner charging amount detection processing to the toners of Y, M and C is same, the processing for the toner of C will be described in the following description, and explanation regarding processing of toners of Y and M will be omitted.

Figure 7:
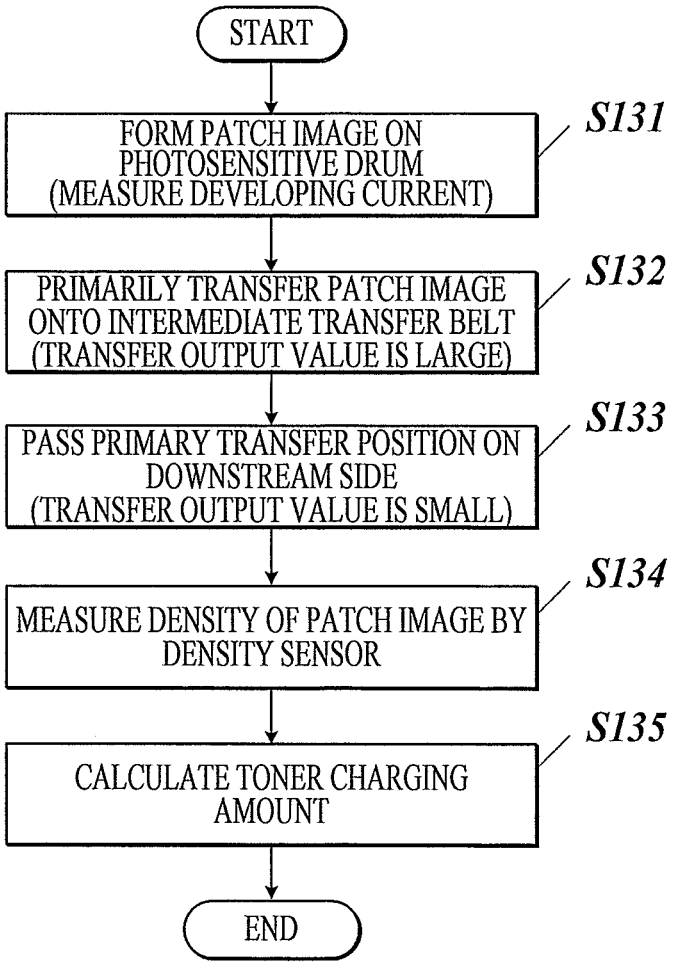
FIG. 7 is a flowchart showing charging amount detection processing of toners of Y, M and C.

As shown in FIG. 7, first, the controller 38 forms a patch image of the toner of C on the photosensitive drum 11C by the writing unit 10C of the image former 10 (step S131).

The image data of the patch image is stored in the storage 39 in advance.

At the time of developing of the patch image, the developing current detector H21 measures developing current between the photosensitive drum 11C and the developing roller 141. Since the developing current is proportional to the total amount of electric charges per unit time of moved toners, it is possible to measure the total amount of electric charges of the developed toners by measuring the developing current.

Next, the controller 38 performs primary transferring onto the intermediate transfer belt 17 of the patch image formed on the photosensitive drum 11C (step S132).

At this time, the output value from the transferring high-voltage power supply H3 to the primary transfer roller 15C corresponding to the developer 14C containing the toners for which the toner charging amount is measured is high compared to that of normal image formation. For example, when the output of transferring high-voltage power supply H3 is a fixed current output, the output value is set to 58 μA whereas the output value of normal image formation is 45 μA. The reason for this is described below.

Figure 8:
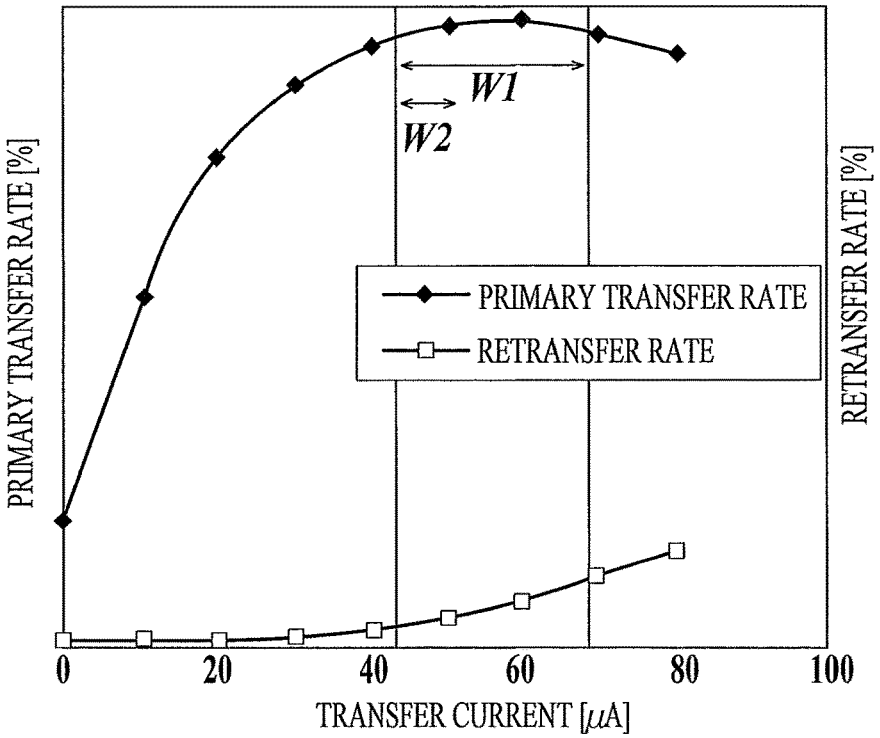
FIG. 8 is a view for explaining the charging amount detection processing in FIG. 6.

FIG. 8 is a graph showing the primary transfer rate and the retransfer rate to different transfer current.

The primary transfer rate is a rate of attachment amount of toners, which were transferred onto the intermediate transfer belt 17 by the primary transfer roller 15C, to the attachment amount of toners developed on the photosensitive drum 11C from the developer 14C.

The retransfer rate is a rate of the attachment amount of toners, which returned to the photosensitive drum 11C at the time of passing the transfer position of the primary transfer roller 15C, to the attachment amount of toners on the intermediate transfer belt 17 formed on upstream side in the rotation direction of the intermediate transfer belt 17 (for example, position of the photosensitive drum 11M).

In FIG. 8, w1 is an appropriate region considering only the primary transferring, and w2 is an appropriate region further considering the retransfer rate.

As shown in FIG. 8, in the normal image forming processing, the transfer current output to the primary transfer roller 15C needs to be set considering the primary transfer rate and the retransfer rate, whereas, in the toner charging amount detection processing in the embodiment, each of them can be set without considering the balance therebetween, and thus, the output value to the primary transfer roller 15C in step S132 is set to be high compared to that of normal image formation since the transfer current can be made appropriate considering only the primary transfer rate.

Returning to FIG. 7, next, the controller 38 makes the output value to the primary transfer roller 15K appropriate so that return to the photosensitive drum 11K is reduced when the patch image passes the transfer position of the primary transfer roller 15K (step S133).

This is an idea similar to that of the above step S132. Since the output value can be made appropriate considering only the retransfer rate, the output value of transferring can be set to low compared to that of the normal image formation. For example, the output value is set to 10 μA, whereas the output value of normal image formation is 45 μA.

Next, the controller 38 measures the optical reflection density of the patch image on the intermediate transfer belt 17 with the density sensor S1 (step S134).

The optical reflection density measured here is converted into the toner attachment amount with the conversion table T1.

Next, the controller 38 calculates the charging amount per unit attachment amount of toner from the total amount of electric charges of toners based on the developing current value measured in step S131 and the toner attachment amount calculated from the optical reflection density value of the patch image measured in step S134 (step S135).

As described above, the toner charging amount detection processing to the toners of Y, M and C is same, and thus, the similar toner charging amount detection processing is also executed for Y and M toners to calculate the charging amount.

Next, with reference to FIG. 9, the toner charging amount detection processing to the K toner will be described.

Figure 9:
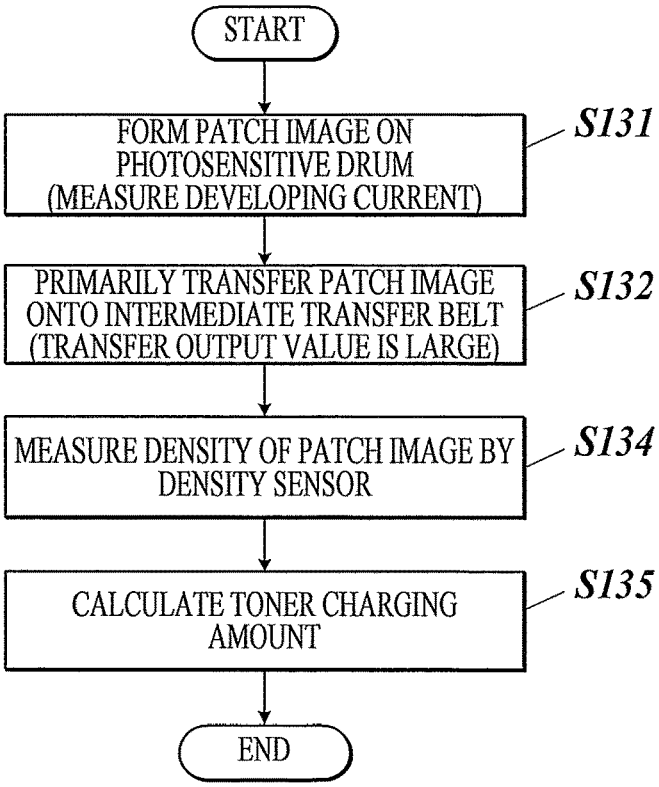
FIG. 9 is a flowchart showing charging amount detection processing of the toner of K.

As shown in FIG. 9, in the toner charging amount detection processing of K toner, there is no primary transferring on downstream side, and thus, the control similar to that of steps S131, S132, S134 and S135 in FIG. 7 is executed except for that the control corresponding to step S133 in FIG. 7 is not performed.

Returning to FIG. 6, the controller 38 executes screen pattern setting processing of setting the screen pattern SP on the basis of the toner charging amount detected by the toner charging amount detection processing (step S14).

Specifically, the controller 38 refers to the setting information T2, selects the screen pattern SP corresponding to the toner charging amount of each color detected by the toner charging amount detection processing, and sets the selected screen pattern SP as the screen pattern SP used for each color.

More specifically, in the embodiment, the screen pattern SP used in the normal image forming processing is set in advance (standard screen pattern SP1 in FIG. 4A).

If the toner charging amount is within the range of normal toner charging amount which is determined in advance, the controller 38 selects the standard screen pattern SP1.

On the other hand, in a case where the toner charging amount is changed, that is, in a case where the toner charging amount becomes out of the range of the normal toner charging amount which is determined in advance, the controller 38 selects the screen pattern SP corresponding to the toner charging amount to perform setting change on the basis of the setting information T2.

The screen pattern SP set for each color as described above is associated with the toner charging amount (value detected in step S13) for each color, and stored in the storage 39. The set screen pattern SP is used during continuous feeding of same paper.

Next, the controller 38 executes image forming processing (step S15).

Specifically, the controller 38 obtains the screen pattern SP which was set in the above screen pattern setting processing for each color from the screen pattern storage 37*b*, performs screen processing to image data for each color with the screen pattern processor 37*a*, and generates image data for image formation. Then, the controller 38 forms a toner image to form an image on a sheet on the basis of the generated image formation data.

Here, according to the embodiment, as described above, the screen pattern SP is set by the toner charging amount. The toner charging amount indicates responsiveness to the electric field on the toner, and has a tendency that the toners easily fly as the value (absolute value) of the charging amount is higher. On the other hand, when the charging amount is high, the electrostatic attachment force between the intermediate transfer belt 17 and the toners becomes larger, leading to a force in the direction of interfering the toners being transferred onto the sheet. Thus, especially on the concaves of embossed paper P1, gaps are generated between the concaves and the toners, and the electric field acting on the toners becomes smaller as the distance therebetween becomes larger. If the applied voltage becomes larger to increase the electric field so as to fly the toners, discharging is generated between the embossed paper P1 and the intermediate transfer belt 17, resulting in the state in which the toners cannot be transferred onto the intermediate transfer belt 17.

That is, when the value of the charging amount is higher due to the deterioration of toners, toners do not easily fly to the concaves of the embossed paper P1 in some cases.

In the embodiment, by setting the screen pattern SP according to the toner charging amount, in a case where the toners are deteriorated (charging amount is high), the screen pattern SP having large dots is set. Large dots are high, shorten the distance from the sheet surface when the toners are transferred onto the sheet, and increase the electric field received by the toners, thus making it easy for the toners to fly. Thus, transferability is improved.

Thus, in a case where the toner charging amount is changed according to the use environment or the use history, it is possible to maintain the good transferability to the concaves of the embossed paper P1 by changing the setting of the screen pattern SP.

Next, the controller 38 determines whether all the image formation is finished for the number of sheets which were set in this job (step S16). If all the image formation is finished (step S16: YES), the processing ends.

On the other hand, if all the processing is not finished (step S16: NO), the controller 38 determines whether it is the adjustment timing in the image forming processing to the embossed paper P1 (step S17). If it is not the adjustment timing (step S17: NO), the controller 38 returns to the above step S15, and repeats the subsequent processing.

On the other hand, if it is the adjustment timing (step S17: YES), the controller 38 executes the charging amount maintenance processing (step S18).

Here, the adjustment timing is, for example, the timing when the accumulated number of image-formed sheets reaches a predetermined number, or the timing when the accumulated image formation time elapsed for a predetermined period, from the start of the image formation of this job.

In a case where image formation is performed continuously to same paper, the image formation is performed continuously by using the set screen pattern SP. However, when it reaches the adjustment timing during the image formation, the charging amount maintenance processing is executed so as to maintain the toner charging amount corresponding to the set screen pattern SP.

Figure 10:
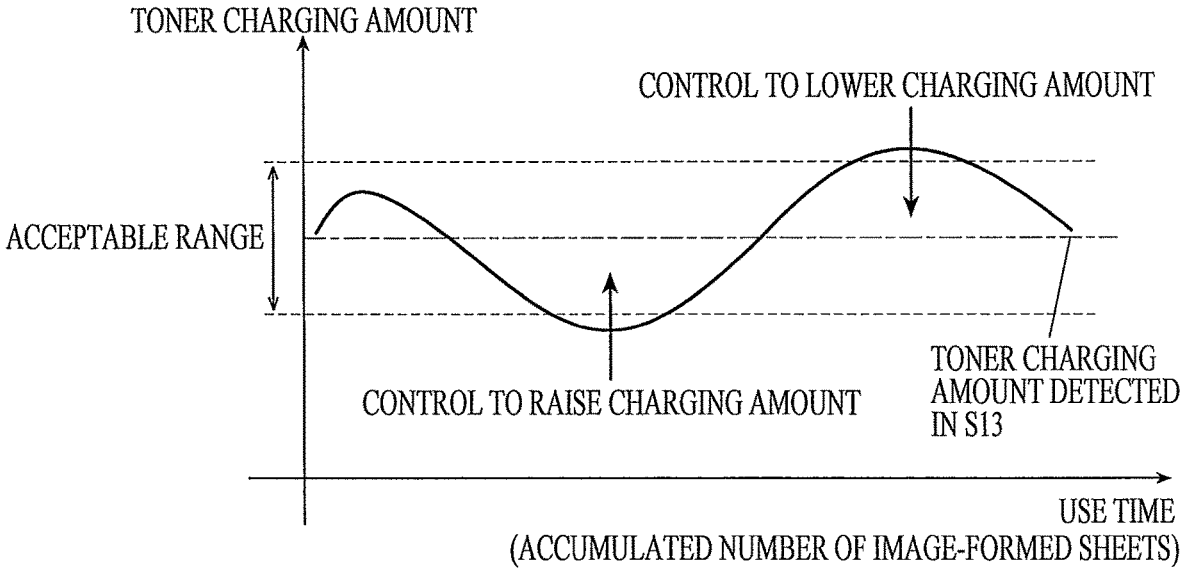
FIG. 10 is a view for explaining charging amount maintenance processing.

Specifically, for example, as shown in FIG. 10, the controller 38 executes the toner charging amount detection processing similar to that of step S13, and in a case where the toner charging amount becomes higher than the value detected in step S13, there is performed a control to lower the toner charging amount to be within the acceptable range (predetermined value) which was set to the toner charging amount detected in step S13. The control to lower the toner charging amount is a control to supply fresh toners (toners having a low charging amount) to the developer, for example. There may be performed a control to increase the supply amount of fresh toners, to increase the supply timing, and the like. In addition to supply of fresh toners, the old toners may be discharged simultaneously.

Though the toner charging amount is lowered by refreshing the toners in any of the above examples, the toner charging amount may be lowered by other methods.

The controller 38 executes the toner charging amount detection processing similar to step S13. If the toner charging amount is lower than the value detected in step S13, the controller 38 executes a control to raise the toner charging amount to be within the acceptable range (predetermined value) which was set to the toner charging amount detected in step S13. The control to raise the toner charging amount is, for example, a control to increase the contact of the toners with carriers by raising the stirring speed in the developer, increasing the number of times of stirring, or the like. There may be performed a control to decrease the supply amount of fresh toners, decrease the supply timing and the like. The toner charging amount may be raised by other methods.

Technical Effect of the Embodiment

As described above, according to the embodiment, in the image forming apparatus G which forms a toner image on the intermediate transfer belt 17 on the basis of the image formation data and forms an image by transferring the toner image onto the embossed paper P1, the controller 38 detects the charging amount of toners forming the toner image, sets the size of dots of the toner image according to the detected toner charging amount value, and generates the image formation data of the dots of the set size with the image processor 37.

Thus, by setting the size of dots according to the toner charging amount, the easiness of fly of toners is changed according to the toner charging amount.

Thus, it is possible to constantly achieve a good transferability to the embossed paper P1.

According to the embodiment, there is provided a screen pattern storage 376 storing a plurality of screen patterns SP in which the sizes of dots are gradually different from each other. The controller 38 sets the size of dots of the toner image by selecting one of the screen patterns SP according to the detected toner charging amount value.

Thus, it is possible to perform the control to change the setting to the dots of the size corresponding to the toner charging amount by selecting the screen pattern SP.

According to the embodiment, the controller 38 increases the size of dots of the toner image as the detected toner charging amount is higher (as the absolute value is larger).

Thus, as the toner charging amount is higher, the size of dots of the toner image increases, and it is possible to make it easier for the toners to fly, and to maintain the stable transferability constantly.

According to the embodiment, in a case of executing the continuous image forming processing of continuously performing image formation to the embossed paper P1 of a same type, the controller 38 continuously generates image formation data of the dots of the set size.

Thus, since the size of dots which was once set is maintained in the continuous image forming processing, it is possible to omit the image stabilization control required each time the screen pattern is changed, for example. Thus, it is possible to suppress the drop of productivity.

According to the embodiment, there is provided a storage 39 which stores the detected toner charging amount, and when it reaches a predetermined timing during the execution of the continuous image forming processing, the controller 38 detects the toner charging amount again, and adjusts the toner charging amount, which was detected again, to be within the predetermined range which was set to the stored toner charging amount by comparing the stored toner charging amount with the toner charging amount which was detected again.

Thus, in the continuous image forming processing, it is possible to maintain the stable transferability without changing the screen pattern SP.

According to the embodiment, there is provided an operator 31 to which the user performs the selection operation of the sheet type, and the controller 38 determines that the sheet used for image formation is the embossed paper P1 by the instruction signal corresponding to the selection operation to the operator 31.

Thus, it is possible to set the sheet type according to the selection operation by the user.

The embodiment to which the present invention can be applied is not limited to the above-mentioned embodiments, and modifications can be made as needed within the scope of the present invention.

For example, though the above embodiment has been described by illustrating the configuration of selecting the size of dots (screen pattern) by detecting the toner charging amount, any parameter regarding the toner charging amount can be used instead of the toner charging amount.

The parameter regarding the toner charging amount is, for example, the value regarding the use state (coverage of image, image pattern, number of image-formed sheets, image forming time or the like), the value regarding the environmental condition (temperature, humidity or the like), or the like. As an example, in a case of image formation on the embossed paper P1, it is possible to execute the control such as setting of screen pattern with respect to the value obtained by conversion on the basis of the average coverage of each color, the number of image-formed sheets and the temperature and humidity of the use environment so far. Or it is possible to execute a control appropriate for the converted value by providing a table.

That is, the toner charging amount is assumed according to the converted value, and the control is performed to increase the size of dots when the value is high.

The embodiments have been described by illustrating the configuration of selecting one screen pattern SP according to the toner charging amount from the plurality of different screen patterns SP which are stored in advance. However, when the toner charging amount is detected, the size of dots of the toner image may be calculated according to the value of the toner charging amount to set the calculated size of dots.

Figure 11:
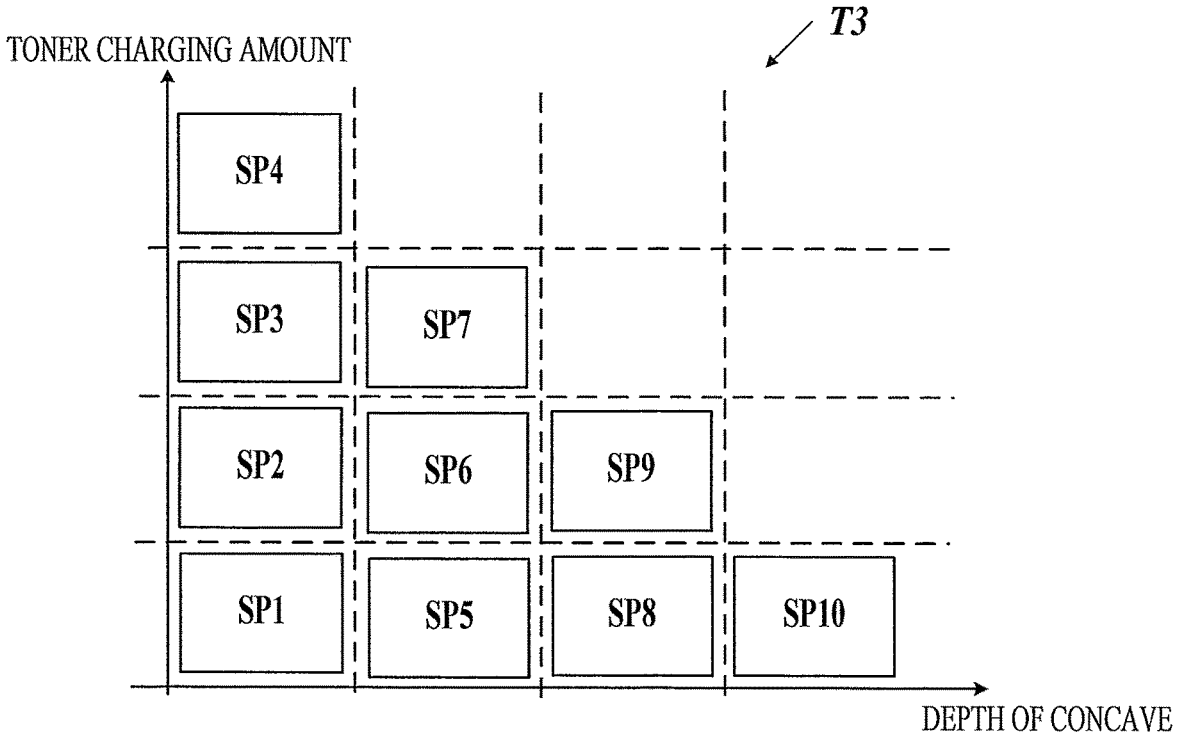
FIG. 11 is a view showing an example of setting information.

Though the screen pattern SP is set by using the setting information T2 associating the toner charging amount with the screen pattern SP in the embodiment, as shown in FIG. 11, the screen pattern may be set by using setting information T3 associating the screen pattern SP with the combination of the toner charging amount and the depth of the concave of the embossed paper P1. By such a way, it is possible to achieve better transferability.

In this case, for example, after the controller 38 determines whether the paper is the embossed paper P1 in step S12, if the paper is the embossed paper P1, the controller 38 may obtain the depth of the concave of the embossed paper P1 with the detection sensor S2. After the toner charging amount detection processing in step S13, the controller 38 sets the size of dots of the toner image according to the detected toner charging amount and the depth of the concave of the embossed paper P1.

Or, the depth of the concave of the embossed paper P may be registered so as to be linked with the type of paper when the user registers the type of paper with the operator 31.

In this case, when the controller 38 determines whether the paper is the embossed paper P1 in step S12, for example, the user may obtain, with the operator 31, the value of the depth of the concave which is linked with the type of paper which was selected as the type of paper to form the image in the job.

Though whether the paper is the embossed paper P1 is determined by the instruction signal corresponding to user's selection operation in the embodiment, the paper may be determined to be the embossed paper P1 on the basis of the detection result by the detection sensor S2.

The detection method of the toner charging amount is not limited to the above.

Also in a case of performing image formation on the embossed paper P1 according to user's operation, there can be a setting so that the above-described screen pattern setting processing is not performed. The screen pattern may be specified according to user's operation.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent Application No. 2017-220579, filed on Nov. 16, 2017, is incorporated herein by reference in its entirety.

What is claimed is:

1. An image forming apparatus which forms a toner image having an image pattern on an image carrier based on image formation data, and transfers the toner image onto a sheet having unevenness on a surface thereof and forms an image, the image forming apparatus comprising:

a hardware processor which detects a parameter value regarding a charging amount of a toner that forms the toner image, sets a size for dots in the toner image according to the detected parameter value, and generates the image pattern to be formed on the image carrier, the image pattern being composed of dots of the set size, wherein the parameter value is a toner charging amount, and wherein the hardware processor increases the size of the dots in the toner image as an absolute value of the detected toner charging amount increases.

2. The image forming apparatus according to claim 1, further comprising a storage which stores a plurality of screen patterns that have dots of graduated different sizes, wherein the hardware processor sets the size of the dots in the toner image by selecting one of the screen patterns according to the detected parameter value.

3. The image forming apparatus according to claim 1, wherein, when continuous image forming processing of continuously performing image formation to a same type of sheet is executed, the hardware processor continuously generates the image formation data which is composed of the dots of the set size.

4. The image forming apparatus according to claim 1, further comprising an operator to which a user performs a selection operation of a type of the sheet, wherein the hardware processor determines that the sheet to form an image on is the sheet having the unevenness on the surface by an instruction signal corresponding to the selection operation performed to the operator.

5. The image forming apparatus according to claim 1, further comprising a detection sensor which detects a surface shape of the sheet, wherein the hardware processor determines the unevenness on the surface of the sheet based on a detection result of the detection sensor.

6. An image forming apparatus which forms a toner image having an image pattern on an image carrier based on image formation data, and transfers the toner image onto a sheet having unevenness on a surface thereof and forms an image, the image forming apparatus comprising:

a hardware processor which detects a parameter value regarding a charging amount of a toner that forms the toner image, sets a size for dots in the toner image according to the detected parameter value, and generates the image pattern to be formed on the image carrier, the image pattern being composed of dots of the set size, and a storage which stores the detected parameter value, wherein, when continuous image forming processing of continuously performing image formation to a same type of sheet is executed, the hardware processor continuously generates the image formation data which is composed of the dots of the set size, and wherein at a predetermined timing during execution of the continuous image forming processing, the hardware processor detects the parameter value again, and the hardware processor compares the parameter value stored in the storage with the parameter value which is detected again, and performs adjustment so that the parameter value detected again is within a predetermined range which is set for the parameter value stored in the storage.

7. A non-transitory computer readable storage medium storing thereon a program for controlling an image forming apparatus which forms a toner image having an image pattern on an image carrier based on image formation data and transfers the toner image onto a sheet having unevenness on a surface thereof and forms an image, wherein the program, when executed by a computer of the image forming apparatus, controls the computer to perform operations of:

detecting a parameter value regarding a charging amount of a toner that forms the toner image, wherein the parameter value is a toner charging amount, setting a size for dots of the toner image according to the detected parameter value, generating the image pattern to be formed on the image carrier, the image pattern being composed of dots of the set size, and increasing the size of the dots in the toner image as an absolute value of the detected toner charging amount increases.

* * * * *